United States Patent [19]

Finch

[11] 4,308,428

[45] Dec. 29, 1981

[54] SYSTEM FOR ELECTRONICALLY SIMULATING RADIATION EFFECTS PRODUCED BY A ROTARY LOUDSPEAKER

[75] Inventor: Robert A. Finch, Mundelein, Ill.

[73] Assignee: CBS Inc., New York, N.Y.

[21] Appl. No.: 107,203

[22] Filed: Dec. 26, 1979

[51] Int. Cl.[3] ..... G10H 1/02

[52] U.S. Cl. ..... 179/1 J; 84/1.24

[58] Field of Search ..... 179/1 J, 1 GP, 1 G; 84/1.24, 1.25, DIG. 26

[56] References Cited

U.S. PATENT DOCUMENTS

| | | | |
|---|---|---|---|
| 3,719,782 | 3/1973 | Barnum | 179/1 J |
| 3,749,837 | 7/1973 | Doughty | 179/1 J |
| 4,008,641 | 2/1977 | Takada et al. | 179/1 J |

*Primary Examiner*—Bernard Konick

*Assistant Examiner*—J. A. Popek

*Attorney, Agent, or Firm*—Spencer E. Olson

[57] ABSTRACT

A device for electronically simulating vibrato and tremulant effects and the radiation effects produced by a rotary loudspeaker with the aid of two loudspeakers, in which a musical tone signal is applied to a variable delay device associated with one of the loudspeakers. The frequency modulated signal produced by the variable delay device is also subjected to amplitude modulation, controlled in synchronism with the variable delay device, and the resulting composite signal applied to the other loudspeaker. Additionally, the high frequency components of the frequency modulated signal from the variable delay device are summed, in and out of phase relationship, with the composite amplitude modulated signal to simulate the effect of a rotating high frequency horn radiator.

24 Claims, 3 Drawing Figures

SYSTEM FOR ELECTRONICALLY SIMULATING RADIATION EFFECTS PRODUCED BY A ROTARY LOUDSPEAKER

BACKGROUND OF THE INVENTION

This invention relates to a system for electronically modulating a musical tone signal, and, more particularly, to a system for modulating a musical tone signal to simulate the radiation effects produced by a rotary loudspeaker.

The addition of pulsato, tremolo, chorus or other low frequency modulation effects to a musical tone signal enhances the richness of the resultant sounds. Pulsato may be produced using rotary sound channels, as shown in Leslie U.S. Pat. Nos. Re. 23,323, 3,080,786 and 3,174,579, among others. In one of the several embodiments disclosed in U.S. Pat. No. Re. 23,323, a high frequency speaker in the form of a directional horn and a lower frequency speaker are rotatably supported in a cabinet and are arranged to be rotated by respective motors. As the horn and low frequency speaker are rotated, not necessarily synchronously, the pitch of the sound reaching the listener's ear varies and, by appropriately choosing the speed of rotation, a pleasing pulsato effect is obtained. The patent teaches that best results are frequently obtained by rotating the speakers at different speeds and in opposite directions, implying that the relative phase of the signals from the two speakers continously varies. While possibly not recognized by the inventor at the time, it was subsequently observed that a somewhat different tremolo is produced at higher frequencies than at the lower end of the spectrum, and that the high frequency rotating horn produces an effect comparable to that occurring in a pine organ at the transition near the top end of the rank from wooden to metal pipes; the small metal pipes react much differently to variations in air pressure and produce a different and much deeper vibrato and tremulant effect than do the wooden pipes. While systems of the general configuration taught by Leslie have enjoyed wide and long-term acceptance, many investigators have attempted to electronically simulate the desirable effect in order to eliminate the bulk and cost of the rotary speakers, and the attendant mechanical problems.

One such electronic system is known from U.S. Pat. No. 4,008,641 which has three channels each coupled to a respective loudspeaker and each having an amplitude modulator therein. A tone signal to be modulated is applied directly to the amplitude modulator in one of the channels and through a delay circuit to the amplitude modulator in each of the other two channels. A frequency modulator is coupled to the amplitude modulator in the first channel and to the delay circuit for frequency modulating the musical tone signals therein, and phase shifters are coupled between the frequency modulator and the respective amplitude modulators in the second and third channels for shifting the phase of the musical tone signal in these channels. The outputs of the amplitude modulators are acoustically reproduced, with the tone signal from the first channel being in the center of the reproduced sound image and the musical tone signals from the other channels on opposite sides of the tone signal from the first channel. The sound emanating from the center speaker is loudest at the transition between sharp and flat of the frequency modulated signal, and one of the side speakers is loudest when the frequency modulated signal is going from flat to sharp while the other side speaker is loudest when the FM signal is going from sharp to flat; this produces the effect of rotation, but does not accurately simulate the acoustic effects produced by a rotary speaker. That is, when the FM modulated signal is going sharp, the signal produced by one of the side speakers is more dominant than it should be. Moreover, proper operation of the system is highly dependent on the relative placement of the speakers, and also requires rather specific positioning of the listener with respect to the speakers for him to perceive a rotating sound effect.

A device for electronically simulating the radiation effects produced by a rotary speaker, which requires only two loudspeakers, is described in U.S. Pat. No. 4,162,372. In this system, an input tone signal is frequency modulated at a sub-audio rate and the frequency modulated signal and the original signal are mixed and applied to two variable gain amplifiers, the outputs of which are applied to respective loudspeakers. The gains of the amplifiers are varied in phase opposition at the aforementioned sub-audio frequency, the modulating signal being applied to the amplifiers through a low-pass filter having a crossover at about 1.0 Hz, so that the amplitude modulation is more pronounced at 0.7 Hz than at 7 Hz. This quite closely simulates the effect in a rotary speaker pulsato generator wherein amplitude modulation is less distinct in the "fast" mode than in the "slow" mode, but because the amplitude modulation occurs in both channels in synchronism, the system does not simulate the effect of a rotary speaker facing away from the listener.

Thus, these two known systems, while each simulates to a degree many of the characteristics of the sound produced when a rotary speaker is used to modulate a musical tone signal, fail to simulate other effects, with the consequence that neither accurately simulates the pulsato and radiation effects produced by a rotary loudspeaker. Moreover, the system of U.S. Pat. No. 4,008,641 is relatively expensive to manufacture and, as has been previously noted, requires a particular placement of the loudspeakers relative to each other, and rather specific positioning of the listener with respect to the speakers, to realize the desired results.

Another device for electronically modulating a musical tone signal to produce substantially the radiation effects produced by a rotary loudspeaker is described in commonly assigned application Ser. No. 107,220 filed concurrently herewith by George F. Schmoll III. This system employs two loudspeakers and has an amplitude modulator associated with one and a variable delay device associated with the other. The musical tone signal is applied to both the amplitude modulator and the variable delay device, and both the variable delay device and the amplitude modulator are modulated synchronously by a sub-audio frequency modulating signal. The amplitude modulator delivers an output to its loudspeaker only during positive half-cycles of the modulating signal, during which time the frequency modulated signal produced by the variable delay device is going from flat to sharp, and during the period that no amplitude modulated tone signal is produced the frequency modulated signal is going from sharp to flat, whereby when the separately reproduced modulated signals are acoustically mixed a rotating sound effect is produced.

It is an object of the present invention to provide a circuit for electronically modulating a musical tone signal to generate tremulant effects simulative of those produced by a rotary loudspeaker. Another object is to produce radiation effects simulative of those produced by a rotatable tremulant sound producer of the type having both low and high frequency rotating channels.

BRIEF DESCRIPTION OF THE INVENTION

Briefly, these objects are achieved by differently modulating a musical tone signal in two signal channels each of which is adapted to be coupled to a respective loudspeaker. The tone signal is first frequency modulated at a sub-audio frequency, typically at either approximately 1.0 Hz or 7.0 Hz for "slow" and "fast" pulsato, respectively, and the frequency modulated signal is applied to a first of the signal channels. The frequency modulated signal is also subjected to amplitude modulation, controlled in synchronism with the variable delay device, and the resulting composite signal applied to the other signal channel. The second signal channel additionally includes means for summing high frequencies contained in the frequency modulated signal, in out-of-phase relationship with the composite signal, to simulate the radiation effect of a high frequency horn radiator.

BRIEF DESCRIPTION OF THE DRAWINGS

Other objects, features and advantages of the invention will become apparent, and its construction and operation better understood, from the following detailed description, taken in conjunction with the accompanying drawings, in which.

DESCRIPTION OF THE PREFERRED EMBODIMENT

Figure 3:
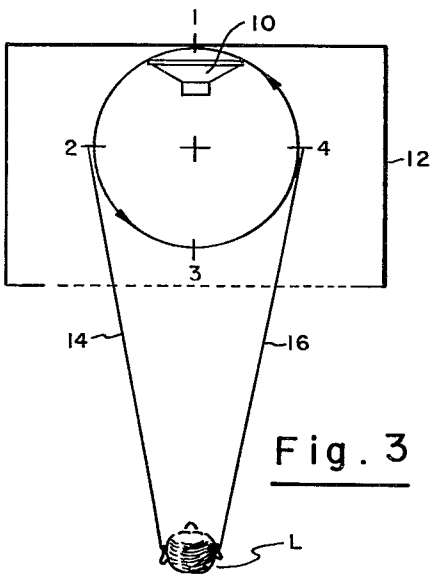
FIG. 3 is a diagrammatical representation of a rotary speaker, useful in illustrating how the system of the present invention produces the radiation effects of a rotary speaker.

The nature of the sound effects produced by a rotary speaker, which the present invention electronically simulates to a high degree, will be seen from consideration of FIG. 3, wherein a speaker 10 is mounted within a cabinet 12 for rotation about a vertical axis, in the direction indicated by the arrows. In the illustrated position of the speaker, namely, with its radiating surface directed toward the back of the cabinet, no direct sound reaches a listener L positioned in front of the cabinet; only sound reflected from the walls of the cabinet is heard by the listener. As the speaker rotates toward position 2, the source of the sound is approaching the listener and due to Doppler effect is perceived as going sharp, and when position 2 is reached and passed, some direct sound reaches the listener along direct sound line 14. The amplitude of the direct sound increases with continued angular displacement of the speaker, along with an increase in the perceived frequency, to a maximum amplitude when the speaker is facing the listener, namely, at position 3. Upon further rotation from position 3 toward position 4, the sound signal reaching the listener decreases in amplitude and its frequency is perceived as going flat, and as speaker 10 leaves the direct sound line 16, the amplitude of the direct signal is reduced toward zero, and the perceived frequency continues going flat, until position 1 is again reached, at which only indirect reflected sound reaches the listener. Conventionally, a rotary speaker is rotated at one of two speeds, namely, to produce modulation at about 0.7 Hz for "slow" pulsato, or to produce 7.0 Hz modulation for "fast" pulsato.

Figure 1:
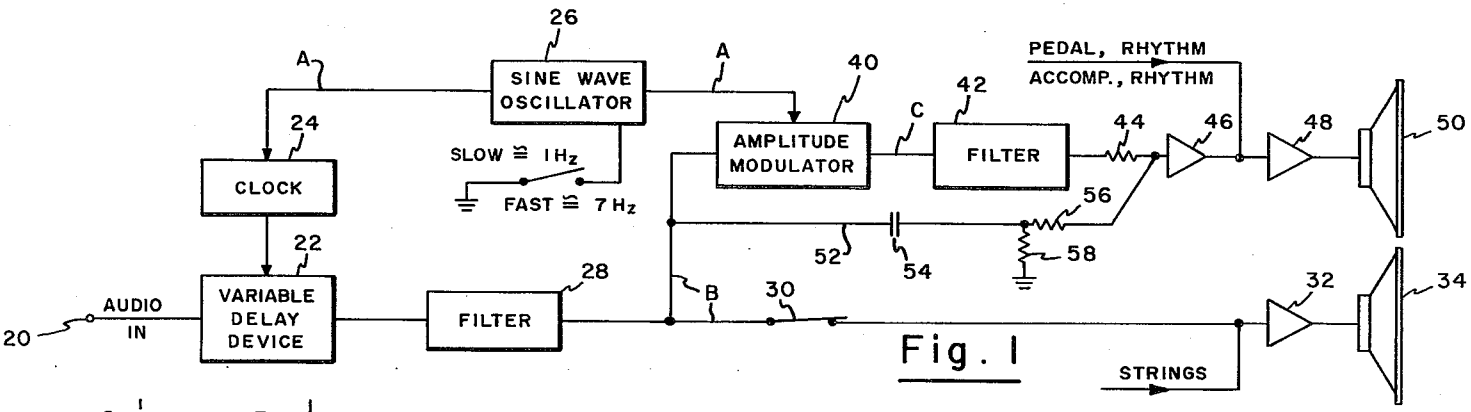
FIG. 1 is a block diagram of a system according to the invention for modulating a tone signal to produce radiation effects simulative of those produced by a rotary speaker.

Referring now to FIG. 1, the system of the present invention receives a musical tone signal at an input terminal 20 which is applied to the input of a variable delay device 22, which may be any of several known variable phase shift devices, and may, for example, take the form of a "bucket brigade" delay line, a form of shift register. Variable delay device 22 is driven by a clock 24 which generates a periodic series of pulses at a given frequency, and the given clock frequency is varied by a sinusoidal modulation wave, shown in FIG. 2A, from a modulation signal generator 26, which may be an oscillator the frequency of which is selectable to be either approximately 1.0 Hz or approximately 7.0 Hz for "slow" and "fast" operation, respectively. The illustrated form of variable delay device is described in Doughty U.S. Pat. No. 3,749,837. The output of variable delay device 22 is applied to a filter 28 which removes from the modulated audio signal the clock pulses which have been impressed on the signal by the variable delay device. The variable delay device causes the time phase of the input tone signal to advance or recede in accordance with the increase or decrease of the varying voltage of the modulating wave, and consequently there is a frequency variation in accordance with the variation of the voltage of the modulating wave per unit time. More specifically, as shown in FIG. 3B, as the voltage of the modulating wave is descending in value the variable delay device causes the time phase of the tone signal to recede and causes the modulated signal to be flat with respect to the input signal, and during periods when the modulating wave is ascending in value, the phase of the musical tone signal is advanced, causing the frequency modulated signal to be sharp with respect to the input audio frequency. The periods during which the frequency modulated signal is sharp and flat is indicated in the diagram immediately below waveform (B), it being understood that the degree of sharpness or flatness is not constant throughout the respective periods but varies in accordance with the voltage of the modulation wave per unit of time, with maximum sharpness and flatness occurring at zero-crossings of the modulation wave. The resulting frequency modulated tone signal is applied through a switch 30 (the purpose of which will be explained presently) to a suitable power amplifier 32 for amplification prior to acoustic reproduction in a first loudspeaker 34.

The frequency modulated signal (B) at the output of filter 28 is also applied to the input of an amplitude modulator 40 wherein it is amplitude modulated by the sinusoidal modulating signal (A) of the same frequency and phase as that employed to control variable delay device 22. Amplitude modulator 40, which may be of conventional design, is operative to provide approximately 80% modulation of the frequency modulated input signal to produce a composite signal, substantially as illustrated in waveform (C) of FIG. 2, the amplitude of which is maximum at transitions from sharp to flat of the frequency modulated signal and minimum at transitions from flat to sharp. The amplitude modulator inverts the phase of the applied input signals so that the phase of the frequency and amplitude modulated signal at the output of the modulator is shifted by 180° relative to the input signal. Higher frequency components of the composite signal are attentuated by a filter 42, the output of which is coupled via a resistor 44 to the input terminal of a summing amplifier 46. The signal appearing at the output of amplifier 46 is further amplified in a suitable power amplifier 48 and applied to a second loudspeaker 50 for acoustical reproduction.

The frequency modulated signal appearing at the output of filter 28, in addition to being applied to amplitude modulator 40, is applied over line 52 through a capacitor 54 and a resistor 56 to the input of summing amplifier 46. The junction of capacitor 54 and resistor 56 is connected through a resistor 58 to ground potential. The frequency modulated signal applied over this path to summing amplifier 46 is of constant amplitude, and because of the phase inversion in amplitude modulator 40, is in phase opposition with the amplitude modulated FM signal applied to the summing amplifier via resistor 44. The values of capacitor 54 and resistor 58 are selected to emphasize only the higher frequencies of the audio spectrum; as a consequence, such high frequency signals applied to summing amplifier 46 via resistor 56, as determined by the values of capacitor 54 and resistor 58, are amplitude modulated in summing amplifier 46 by virtue of the summation of the FM signal passed by the RC filter and the amplitude modulated FM signal from modulator 40 passed by filter 42. Only the high frequencies are affected and the modulation occurs 180° out of phase relative to the amplitude modulation of the main signal from amplitude modulator 40. The resulting composite envelope for the high audio frequencies, typically, from about 3 KHz and above, is essentially as illustrated in waveform (D) of FIG. 2, from which it is seen that the amplitude modulation is approximately 100% and in opposite phase relative to the amplitude modulation of lower frequencies in the system, depicted by waveform (C). The percentage of modulation varies with frequency, being lower at the lower end of the high frequency portion of the spectrum and increasing with frequency until a frequency is reached at which 100% modulation is approached or met; that is, where the amplitude of the high frequency signal summed into amplifier 46 via resistor 56 is substantially equal to the amplitude of the signal summed in through resistor 44 from amplitude modulator 40. The electrical mixing of the composite signals (C) and (D) with the resultant reinforcement and cancellation of signal elements on a somewhat random basis gives a much deeper and broader vibrato and tremulant effects to the very high frequencies in the system as compared to the effects produced at low and mid-range frequencies. The effect at high frequencies is quite simulative of that produced by the high frequency horn in the above-described Leslie system and also somewhat simulates the effects of reflections within the cabinet of a rotary speaker system, which is not totally sound transparent.

While the just-described channel simulates by electrical mixing the effects of a rotating high frequency horn and other desirable tremulant effects, the production of effects produced by a rotary loudspeaker depends on the acoustic mixing of the modulated tone signals produced by both speakers. The acoustically mixed musical tone signals will have complicated modulation effects, and they will at the same time have a rotation sound effect due to the described phase relationships between the frequency modulated signal reproduced by speaker 34 and the composite amplitude modulated FM signal reproduced by speaker 50. Although the placement of speakers 34 and 50 with respect to each other is not critical to obtaining an acceptable spatial effect, they should be reasonably close to each other.

Figure 2:
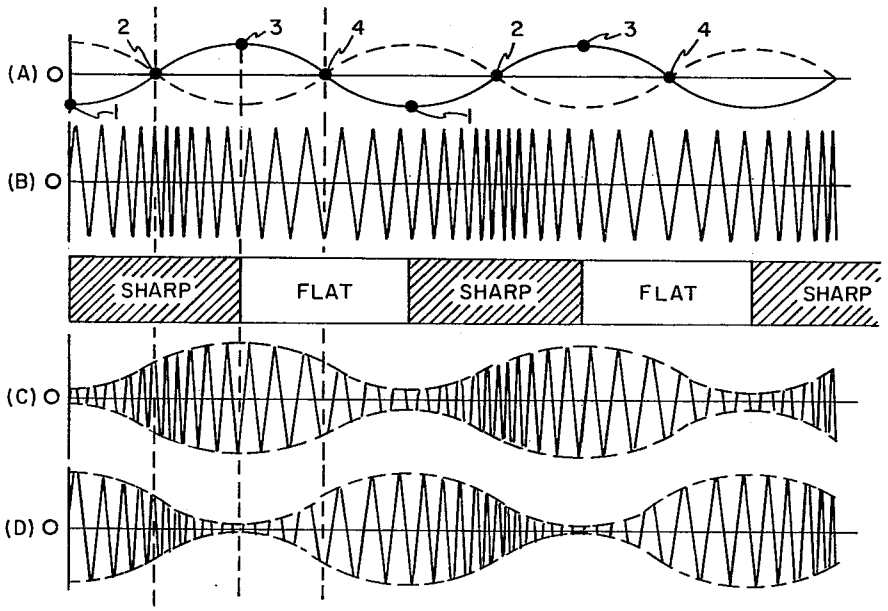
FIG. 2 is a series of waveforms of signals at various points in the system of FIG. 1, useful in explaining the operation of the system.

Relating the waveforms of FIG. 2 to the diagrammatical representation of a rotary speaker, with the numerals 1, 2, 3 and 4 on the modulation waveform (A) corresponding to like numbered positions of the rotary speaker, the manner in which the present circuit simulates the radiation effects of a rotary speaker will now be described. At position 1 (when the speaker is facing the back of the cabinet) there is only a relatively low amplitude output from the amplitude modulator 40 (i.e., very little direct sound), and the reflected sound from a rotary speaker is simulated by the output of speaker 34, in which the frequency modulated tone signal starts to go sharp at point 1. At point 2, corresponding to the 90° position of the rotary speaker, there begins to be a significant output from the amplitude modulation channel, which increases in amplitude as the voltage of the modulation wave increases from point 2 to point 3. Meanwhile, the output of the frequency modulation channel is still sharp, thereby to simulate the effect of the rotary speaker rotating toward the listener in going from position 2 to position 3. At point 3 on waveform (A), corresponding to the rotary speaker facing front, the signal reproduced by speaker 50 is at maximum amplitude, and the frequency modulated signal reproduced by speaker 34 is in transition from sharp to flat, thereby simulating the effect of a rotary speaker starting to move away from the listener. At point 4 on waveform (A), corresponding to the position at which a rotary speaker is leaving the direct sound line 16 to the listener, the amplitude of the amplitude modulated FM signal is decreasing in amplitude, and the frequency modulated signal continues to go flat, thus simulating the effect produced by a rotary speaker when going from position 4 back to position 1. The acoutically mixed musical tone signals create the perception that the mixed signal is coming from a common source. The resultant signal has complicated modulation effects, which, together with the cyclical increase and decrease in perceived amplitude and the cyclical variations in frequency from sharp to flat in the described time relationship with the changes in amplitude, simulate to a high degree the modulation effects produced by a rotary speaker. The rotational effect is perceived by the listener throughout a wide angle of positions in front of the loudspeakers; that is, the effectiveness of the system is not significantly dependent on the position of the listener with respect to the loudspeakers. In an organ system embodying the invention, speaker 50 is of the sealed enclosure type having good response at low frequencies, into which are mixed, along with the composite amplitude modulated signal from summing amplifier 46, pedal signals, rhythm signals, accompaniment rhythms and signals representing other organs sounds. Signals representing brighter voices, such as strings, are mixed with the frequency modulated signal from filter 28 for reproduction by speaker 34, which desirably has a better high frequency response than speaker 50. Typically, only the tibia-representing signals are applied to input terminal 20 and processed to produce the rotary loudspeaker radiation effects.

An advantageous feature of the present system is that the power amplifier 32 and speaker 34 can readily be eliminated from the system by opening of switch 30, and the remainder of the system used to provide a tremolo effect by reproducing only the composite signal consisting of the amplitude modulated FM signal, modulated in synchronism with each other. Although elimination of the frequency modulation channel detracts from the simulation of rotation effects, the balance of the system nevertheless produces a very pleasant tremolo effect which is quite acceptable in an inexpensive organ utilizing a single speaker. The previously described characteristic of the modulation at the upper end of the audio frequency spectrum due to the summing of the high frequencies out of phase with the amplitude and frequency modulated main signal still obtains whether or not speaker 34 is used. Thus, unlike the above-described Schmoll system wherein the two channels are totally separated and the radiation effects of a rotary speaker are obtained entirely by acoustic mixing, in the present system the audio signal is, in effect, serially processed, first by frequency modulation and then by amplitude modulation, in essentially the same synchronism as in the Schmoll system. Thus, the system to the left of switch 30 in FIG. 1 can be utilized as a building block for producing tremulant effects in an inexpensive organ otherwise requiring only one speaker, and which by adding only another speaker will provide a rotational radiation effect.

From the foregoing description it is seen that the present invention produces modulation effects highly simulative of that produced by a rotating speaker/horn arrangement, and which is relatively inexpensive to manufacture from conventional commercially available components.

I claim:

1. Circuit for use with two proximately positioned loudspeakers for electronically producing an effect which simulates the radiation of sound by a rotary loudspeaker, said circuit comprising:

means for generating a sub-audio frequency, substantially sinusoidal, modulating signal;

variable delay means connected to receive an audio input signal and responsive to said modulating signal to modulate the frequency of said audio input signal;

means connected to the output of said variable delay means adapted to apply to a first of said loudspeakers the signal modulated in frequency;

an amplitude modulator connected to receive said frequency modulated signal from said variable delay means and responsive to said modulating signal to modulate the amplitude of said frequency modulated signal to produce a composite amplitude modulated frequency modulated output signal; and means connected to the output of said amplitude modulator adapted to apply said composite output signal to a second of said loudspeakers.

2. Circuit according to claim 1, wherein the phase relationship of the modulating signal applied to said variable delay means and to said amplitude modulator is such that said composite signal has maximum amplitude when the frequency modulated signal is in transition from sharp to flat relative to the audio input signal and has minimum amplitude when the frequency modulated signal is in transition from flat to sharp.

3. Circuit according to claim 1 or 2, wherein said amplitude modulator inverts the phase of the frequency modulated audio signal it receives from said variable delay means, and wherein said circuit further comprises:

a high-pass filter connected to receive said frequency-modulated audio signal from said variable delay means, and a summing amplifier connected to receive selected frequencies of the composite output signal from said amplitude modulator and also connected to receive from said high-pass filter the higher frequencies of the frequency modulated audio signal, without phase inversion, whereby the higher frequency components of said frequency modulated signal are amplitude modulated by the summation in said summing amplifier of selected frequencies of the composite output signal from said amplitude modulator and the higher frequency components of the frequency modulated signal.

4. Circuit according to claim 3, wherein the frequency of said modulating signal is selectable to be either in the range 0.7 Hz to about 1.0 Hz or about 7.0 Hz, to simulate the slow or fast action of a rotary loudspeaker.

5. Circuit according to claim 3, wherein said high-pass filter is a resistance-capacitance filter adapted to pass frequencies above about 3 KHz.

6. Circuit according to claim 1, wherein said variable delay means is in the form of a bucket brigade shift register and a clock connected to the shift register for generating a periodic series of pulses at a given frequency, and wherein said modulating signal is applied to the clock for varying the given frequency of the clock.

7. System for modulating a musical tone signal to produce an effect which simulates the radiation of sound by a rotary loudspeaker, said system comprising:

means for generating a sub-audio, frequency, substantially sinusoidal, modulating signal;

a first signal channel containing a frequency modulator connected to receive a musical tone signal and responsive to said modulating signal to modulate the frequency of said musical tone signal, and first transducer means for converting the frequency modulated tone signal into sound; and a second signal channel containing an amplitude modulator connected to receive said frequency modulated tone signal from said frequency modulator and responsive to said modulating signal to modulate the amplitude of said frequency modulated tone signal and produce a composite amplitude modulated-frequency modulated output signal having maximum amplitude when said frequency modulated signal is in transition from sharp to flat relative to said input tone signal and having minimum amplitude when said frequency modulated signal is in transition from flat to sharp, and second transducer means for converting the said composite output signal into sound;

said first and second transducers being positioned sufficiently proximate each other that the sound therefrom is acoustically mixed.

8. System according to claim 7, wherein said amplitude modulator inverts the phase of the frequency modulated tone signal it receives from said frequency modulator, and wherein the second signal channel of said system further comprises:

a high-pass filter connected to receive said frequency modulated tone signal from said frequency modulator, and a summing amplifier connected to receive at its input the composite signal from said amplitude modulator and the higher frequency components of said frequency modulated tone signal from said high-pass filter.

9. System according to claim 8, wherein said high-pass filter is a resistance-capacitance filter adapted to pass frequencies above about 3 KHz.

10. System according to claim 7 or 8, wherein the frequency of said modulating signal is selectable to be either about 1.0 Hz or about 7.0 Hz for simulating "slow" and "fast" operation, respectively, of a rotary speaker.

11. Circuit for producing a modulated musical tone signal which when converted to sound by two proximately positioned loudspeakers produces an effect simulative of the radiation of sound by a rotary loudspeaker, said circuit comprising:

means for generating a sub-audio frequency, substantially sinusoidal, modulating signal;

means responsive to said modulating signal for modulating the frequency of a musical tone signal and adapted to apply said frequency modulated tone signal to a first of said loudspeakers;

an amplitude modulator connected to receive said frequency modulated signal and responsive to said modulating signal for modulating the amplitude of said frequency modulated signal to produce a composite output signal; and means adapted to apply the output of said amplitude modulator to the second of said loudspeakers.

12. Circuit for modulating a musical tone signal, which modulated signal when converted to sound by two proximately positioned loudspeakers produces an effect which simulates the radiation of sound by a rotary loudspeaker, said circuit comprising:

means for generating a sub-audio frequency, substantially sinusoidal, modulating signal;

a frequency modulator connected to receive a musical tone signal and responsive to said modulating signal to modulate the frequency of said musical tone signal;

means connected to the output of said frequency modulator adapted to apply to a first of said loudspeakers the signal modulated in frequency;

an amplitude modulator connected to receive the frequency modulated tone signal from said frequency modulator and responsive to said modulating signal to modulate the amplitude of said frequency modulated tone signal to produce a composite output signal; and means connected to the output of said amplitude modulator adapted to apply said composite signal to the second of said loudspeakers.

13. Circuit for modulating a musical tone signal to produce an effect which simulates the radiation of sound by a rotary loudspeaker, said circuit comprising:

means for generating a sub-audio frequency, substantially sinusoidal, modulating signal;

a frequency modulator connected to receive a musical tone signal and responsive to said modulating signal to modulate the frequency of said musical tone signal;

means connected to the output of said frequency modulator for applying the signal modulated in frequency to a first stationary transducer for converting the frequency-modulated tone signal into sound;

an amplitude modulator connected to receive the frequency-modulated signal from said frequency modulator and responsive to said modulating signal to modulate the amplitude of said frequency-modulated signal to produce a composite output signal, and means connected to the output of said amplitude modulator for applying said composite output signal to a second stationary transducer for converting said composite signal into sound.

14. Circuit in accordance with claim 11, 12 or 13, wherein the phase relationship of the modulating signal utilized for frequency and amplitude modulation is such that said composite signal has maximum amplitude when the frequency modulated signal is in transition from sharp to flat relative to the musical tone signal and has minimum amplitude when the frequency modulated signal is in transition from flat to sharp.

15. Circuit in accordance with claim 14, wherein said amplitude modulator inverts the phase of the frequency-modulated signal it receives, and wherein said circuit further comprises a summing amplifier having an input and an output, first means for coupling the composite output signal from said amplitude modulator to the input of said summing amplifier, and second means for coupling the frequency-modulated tone signal, without phase inversion, to the input of said summing amplifier, at least one of said first and second coupling means including means for attenuating the signal transmitted thereby to a degree depending on its frequency and differently from the attenuation of the other of said coupling means, whereby to produce at said output a signal modulated in amplitude by summation in said summing amplifier of the signals coupled thereto by said first and second coupling means.

16. Circuit in accordance with claim 15, wherein said first coupling means comprises a low-pass filter, and wherein said second coupling means comprises a high-pass filter.

17. Circuit in accordance with claim 11, 12 or 13, wherein said amplitude modulator inverts the phase of the frequency-modulated signal it receives, and wherein said circuit further comprises a high-pass filter connected to receive said frequency-modulated tone signal, and a summing amplifier connected to receive selected frequency components of the composite signal from said amplitude modulator and also connected to receive from said high-pass filter the higher frequencies of the frequency modulated tone signal, without phase inversion, whereby the higher frequency components of said frequency-modulated tone signal are amplitude modulated by the summation in said summing amplifier of selected frequencies of said composite signal and the higher frequency components of said frequency modulated tone signal.

18. Circuit in accordance with claim 17, wherein said high-pass filter attenuates said frequency modulated signal to a degree depending on the frequency, so that the percentage amplitude modulation produced in the summing amplifier varies with the frequency of said higher-frequency components.

19. Circuit in accordance with claim 17, wherein said high-pass filter is a resistance-capacitance filter which passes frequencies above about 3 KHz.

20. Circuit in accordance with claim 12 or 13, wherein said frequency modulator comprises:

a bucket-brigade shift register and a clock connected to the shift register for generating a periodic series of pulses at a given frequency, and wherein said modulating signal is applied to the clock for varying the given frequency of the clock.

21. Circuit in accordance with claim 13, wherein said first and second transducers are positioned sufficiently close to each other that the sound separately produced by the transducers is acoustically mixed.

22. System for modulating a musical tone signal to produce a tremolo effect when acoustically reproduced, said system comprising:

means for generating a sub-audio frequency, substantially sinusoidal, modulating signal;

a frequency modulator connected to receive a musical tone signal and responsive to said modulating signal to modulate the frequency of said musical tone signal;

an amplitude modulator connected to receive the frequency modulated tone signal from said frequency modulator and responsive to said modulating signal to modulate the amplitude of said frequency modulated tone signal to produce a composite signal, said amplitude modulator inverting the phase of the frequency-modulated signal it receives from said frequency modulator;

a high-pass filter connected to receive said frequency modulated signal from said frequency modulator;

a summing amplifier connected to receive at its input selected frequency components of the composite signal from said amplitude modulator and also the higher frequencies of the frequency modulated tone signal, without phase inversion, from said high-pass filter, for summing said composite signal and the higher frequency components of said frequency modulated tone signal and modulating the amplitude of the higher frequency components of said frequency modulated tone signal; and a first stationary transducer connected to receive the output signal from said summing amplifier for converting said output signal into sound.

23. System in accordance with claim 22, wherein said system further comprises a low-pass filter connected to receive said composite signal from said amplitude modulator, and wherein said summing amplifier is connected to said low-pass filter to receive the lower frequencies of said composite signal.

24. System in accordance with claim 22 or 23 wherein said system further comprises:

a second transducer connected to receive the frequency modulated tone signal from said frequency modulator for converting the same into sound, said first and second transducers being positioned sufficiently proximate each other to effect acoustical mixing of the sounds separately produced by the transducers.

* * * * *